US005758726A

United States Patent [19]

Streich et al.

[11] Patent Number: 5,758,726

[45] Date of Patent: Jun. 2, 1998

[54] BALL DROP HEAD WITH ROTATING RINGS

[75] Inventors: Steven G. Streich; David F. Laurel, both of Duncan, Okla.

[73] Assignee: Halliburton Energy Services, Duncan, Okla.

[21] Appl. No.: 730,805

[22] Filed: Oct. 17, 1996

[51] Int. Cl.[6] ..... E21B 23/03

[52] U.S. Cl. ..... 166/379; 137/268; 166/75.15; 166/381

[58] Field of Search ..... 166/70, 75.15, 166/284, 291, 379, 381; 137/268

[56] References Cited

U.S. PATENT DOCUMENTS

| | | | |
|---|---|---|---|
| 2,961,045 | 11/1960 | Stogner et al. . | |
| 2,961,046 | 11/1960 | Moeller et al. . | |
| 3,130,783 | 4/1964 | Orr | 166/284 |
| 3,372,705 | 3/1968 | Bodhaine | 137/268 |
| 3,512,554 | 5/1970 | Childers | 137/268 X |
| 4,073,303 | 2/1978 | Foley, Jr. | 137/268 X |
| 4,420,040 | 12/1983 | Arbasak et al. | 166/70 |
| 4,491,177 | 1/1985 | Baugh | 166/75.15 |
| 5,095,988 | 3/1992 | Bode | 166/291 |
| 5,205,359 | 4/1993 | Stephenson | 166/284 |

OTHER PUBLICATIONS

Halliburton Services Sales & Service Catalog No. 44, pp. 28–30 and 128–131 (1990).

Brochure from Firestone 4001 (Undated).

Brochure from Frank's International, Aug. 14, 1995.

*Primary Examiner*—George A. Suchfield

*Attorney, Agent, or Firm*—Craig W. Roddy; Neal R. Kennedy

[57] ABSTRACT

A ball drop head for dropping balls into a tubing or casing string of a well. The ball drop head has a central container with at least one ball carrier ring rotatably disposed therein. A ball cavity is defined in the ring, and a ball is disposed therein. The ball is biased radially inwardly toward the container so that when the ring is rotated to align the cavity with a ball release opening defined in the container, the ball is pushed through the ball release opening to enter and fall through a central opening in the container. The ring may be rotated manually or remotely, such as by inflating a pneumatic or hydraulic bellows. Additional rings may be mounted on the container to use in dropping additional balls. A method of dropping balls into a well is also disclosed.

40 Claims, 3 Drawing Sheets

BALL DROP HEAD WITH ROTATING RINGS

BACKGROUND OF THE INVENTION

1. Field Of The Invention

This invention relates to tools for dropping balls into a tubing or casing string of a well, and more particularly, to a ball drop head which releases balls by rotation of a ring on the tool.

2. Brief Description Of The Prior Art

In the course of operating downhole tools in an oil or gas well, it is sometimes necessary to release variously sized balls or plugs from the surface into the tubing or casing string. The devices used for dropping balls or plugs are sometimes referred to as cementing heads, plug containers or ball dropping heads.

A common method of releasing balls in these types of devices involves the use of linear actuators which are operated by either being rotated by a screw mechanism from the outside of the container or by a remote controlled piston on the outside of the container. The nature of these linear actuators is such that they protrude from the side of the container far enough to be cumbersome to use and are sometimes a problem on the rig floor. Because of the extension of the linear actuators, the operator may not be able to rotate the container because the distance between the bails is not sufficient to clear the actuators and allow them to rotate freely.

The present invention solves this problem by providing a compact mechanism for releasing balls into the tubing or casing string. A rotating ring design is used which permits easy release of the balls, and it also improves conditions for the rig hands because it can be remotely controlled from the floor of the rig. The present invention also provides a means of circulating fluids through the container prior to, and after release of, the balls, since the bails are retained on the outside of the container prior to release. This permits the use of the apparatus with top drive units.

SUMMARY OF THE INVENTION

The ball drop head with rotating rings of the present invention is designed for use in dropping balls into a tubing or casing string of an oil or gas well. The balls are retained on the outside of a container portion inside cavities defined within rings mounted on the container. These rings are positioned such that they can be rotated about the outside of the container. When the cavity in which a particular ball is originally retained is aligned with a corresponding hole in the container, the ball is injected by a biasing means, such as a spring, into a central opening of the container. The ball is thus free to proceed downwardly inside the tubing or casing string.

The rings may be rotated manually or remotely, such as by a hydraulic or pneumatic piston or bellows mechanism or electric motor/screw mechanism. The preferred embodiment incorporates a bellows which generally conforms to the circumference of the container and which provides the necessary force to rotate the corresponding ring. The rings may be independently rotated, and stops are provided to prevent over-rotation of the rings. The stop assures that the cavity in the rotated ring is properly aligned with the corresponding hole in the container so that the ball will be properly released into the central opening of the container when desired.

Specifically, the ball dropping apparatus of the present invention comprises container means for connecting to a tool string and a ball carrier disposed on the container means. The container means defines a central opening therethrough and a ball release opening in communication with the central opening. The ball carrier defines a ball cavity therein and is rotatable between a first position wherein the ball cavity is angularly displaced from, or unaligned with, the ball release opening and a second position wherein the ball cavity is substantially aligned with the ball release opening. The apparatus also comprises a ball disposed in the ball cavity.

The invention preferably further comprises actuating means for moving the ball carrier from the first to the second position. This actuating means may be characterized by an inflatable bellows. In one preferred embodiment, the apparatus further comprises a container retainer block attached to the container means and a ball carrier retainer block attached to the ball carrier. The bellows is disposed between the container retainer block and the ball carrier retainer block such that, as the bellows is inflated, the ball carrier retainer block and the ball carrier are rotated with respect to the container retainer block and the container. A manifold block provides a means for connecting a pneumatic or hydraulic pressure source to the bellows. A stop means may be provided for limiting movement of the ball carrier retainer block.

The apparatus may also comprise sealing means for sealing between the ball carrier and the container means.

Additionally, the apparatus preferably comprises biasing means for biasing the ball toward the ball release opening when the ball carrier is in the second position thereof. The biasing means may be characterized by a spring disposed in the ball cavity adjacent to the ball, and a retaining means may be used for retaining the biasing means in the ball carrier.

The present invention also includes a method of dropping a ball into a well comprising the step of positioning a ball drop apparatus above the well wherein the apparatus comprises a container defining a central opening therethrough and a transverse opening in communication with the central opening, a ring rotatably disposed on the container and defining a cavity therein, and a ball disposed in the cavity. The method further comprises the steps of rotating the ring from a closed position wherein the cavity is displaced from the transverse opening and an open position wherein the cavity is substantially aligned with the transverse opening, and biasing the ball from the cavity through the transverse opening into the central opening of the container.

The step of positioning preferably comprises attaching the ball drop apparatus to a top drive unit and lowering the ball drop apparatus with the top drive unit toward the well.

The step of rotating may comprise inflating a bellows adapted for engagement with the ring and the container.

The step of biasing preferably comprises positioning a pre-loaded spring in the cavity adjacent to the ball. The method may additionally comprise the step of preventing the spring from entering the central opening of the container during and after the step of biasing.

The apparatus described in the method may have a plurality of rings disposed on the container, and the steps of rotating the ring and biasing the ball may be repeated for each ring and corresponding ball.

Numerous objects and advantages of the invention will become apparent as the following detailed description of the preferred embodiment is read in conjunction with the drawings which illustrate such embodiment.

DESCRIPTION OF THE PREFERRED EMBODIMENT

Figure 1:
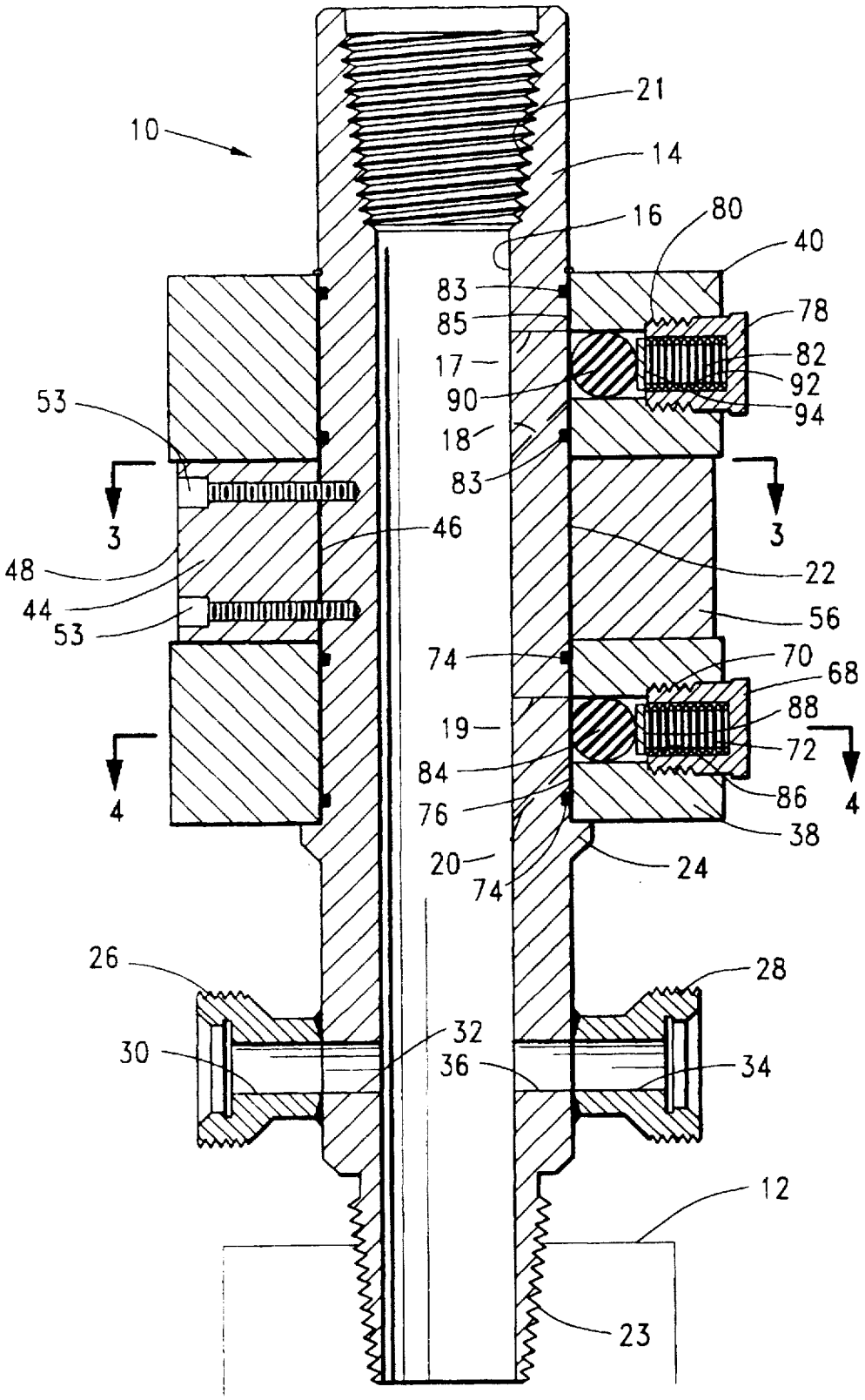
FIG. 1 is a longitudinal cross section taken along lines 1—1 in FIG. 3 showing the ball drop head with rotating rings of the present invention in a closed position prior to releasing balls into a well.

Referring now to the drawings, and more particularly to FIG. 1, the ball drop head with rotating rings of the present invention is shown and generally designated by the numeral 10. Ball drop head or apparatus 10 is designed to be placed in communication with a tubing or casing string 12. For example, but not by way of limitation, tubing string 12 may include a cementing tool of a kind known in the art which is actuated by dropping balls into the tubing string.

Figure 2:
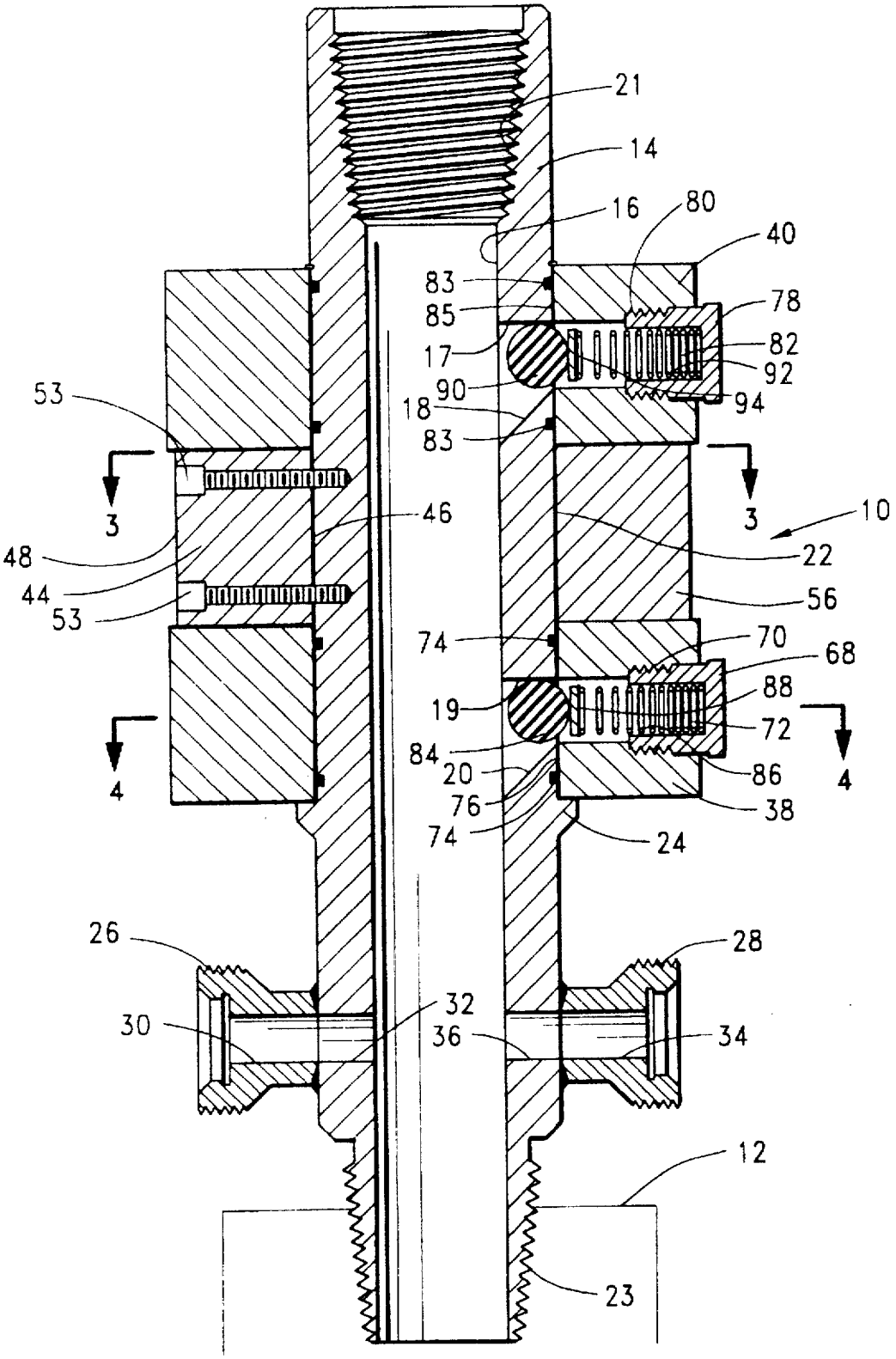
FIG. 2 is a longitudinal cross section taken along lines 2—2 in FIG. 3 and illustrating the ball drop head with the rings rotated to an open or ball releasing position.

Apparatus 10 includes a body or container 14 defining a central opening 16 therethrough. As best seen in FIG. 2, container 14 also defines an upper ball release opening 17 which extends transversely therethrough and is in communication with central opening 16. Upper ball release opening 17 is defined at least in part by a downwardly angled surface 18 in container 14. A lower ball release opening 19 is also defined transversely through container 14 and is in communication with central opening 16. Lower ball release opening 19 is defined at least in part by another downwardly angled surface 20 in container 14. As will be further described herein, lower ball release opening 19 and upper ball release opening 17 may also be referred to as first and second ball release openings 19 and 17, respectively.

At the upper end of container 14 is a female upper connector 21, and at the lower end of container 14 is a male lower connector 23. Lower connector 23 is adapted for connecting to string 12. Upper connector 21 is also connected to other known tools, such as a top drive unit (not shown).

Container 14 has an outside diameter 22 with a radially outwardly extending shoulder 24 thereon.

A first connector 26 and a second connector 28 are attached to the lower end of container 14 below shoulder 24. Preferably, first and second connectors 26 and 28 are permanently attached to container 14, such as by welding. First connector 26 has an opening 30 therethrough which is aligned with a transverse port 32 defined in container 14 and in communication with central opening 16. Similarly, second connector 28 defines an opening 34 therethrough which is in communication with another transverse port 36 defined in container 14. First and second connectors 26 and 28 are adapted for connection to fluid circulating lines (not shown) of a kind known in the art. It should be noted that first and second connectors 26 and 28 are not necessarily located along section lines 1—1 or 2—2. First and second connectors 26 and 28 are illustrated in section in FIGS. 1 and 2 for clarity. Normally, connectors 26 and 28 will be angularly spaced at 180° from one another, but the invention is not intended to be limited to any particular configuration.

A first or lower ball carrier ring 38 is rotatably disposed on outside diameter 22 of container 14 and is supported by shoulder 24 on the container. A second or upper ball carrier ring 40 is rotatably disposed on outside diameter 22 and is spaced above lower ring 38.

Figure 3:
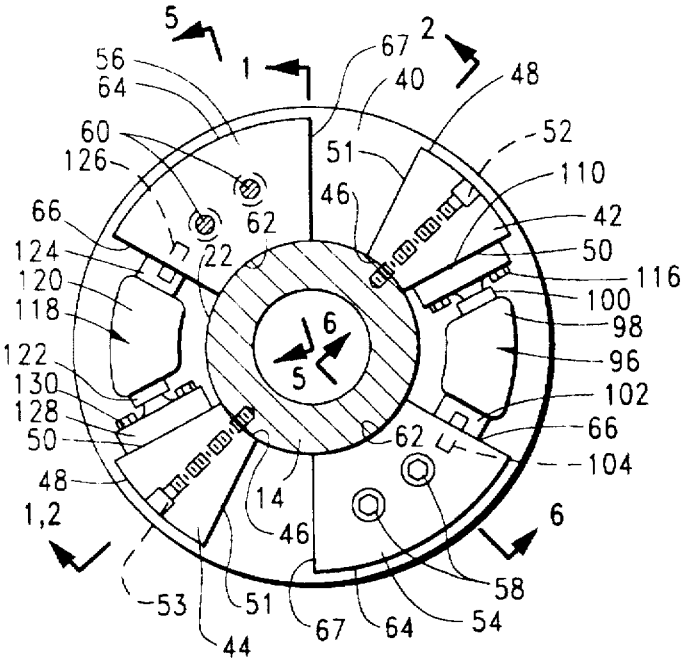
FIG. 3 is a cross section taken along lines 3—3 in FIG. 1.

Referring now also to FIG. 3, first and second container retainer blocks 42 and 44 are disposed between lower ring 38 and upper ring 40. First container retainer block 42 has an arcuate inner surface 46 adapted for engagement with outside diameter 22 of container 14. Retainer block 42 also has an arcuate outer surface 48 and a pair of radially disposed sides 50 and 51 extending between inner surface 46 and outer surface 48. A fastening means, such as a pair of screws 52, is used to fixedly attach retainer block 42 to container 14.

Second container retainer block 44 is substantially identical to first retainer block 42 and is also attached to container 14 by a fastening means, such as a pair of screws 53. Preferably, but not by way of limitation, first and second container retainer blocks 42 and 44 are oppositely disposed, i.e., spaced at 180° from one another about a central axis of container 14.

Figure 5:
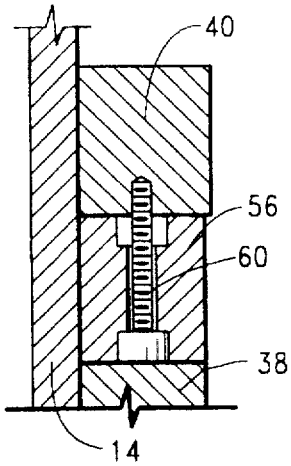
FIG. 5 shows a vertical cross section along lines 5—5 in FIG. 3.
Figure 6:
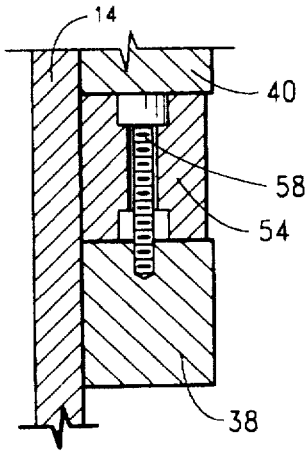
FIG. 6 is a vertical cross section taken along lines 6—6 in FIG. 3.

Also disposed between upper and lower rings 38 and 40 are a first ring retainer block 54 and a second ring retainer block 56. First ring retainer block 54 is fixedly attached to lower ring 38 by a fastening means, such as a pair of screws 58, as best seen in FIG. 6. Similarly, second ring retainer block 56 is fixedly attached to upper ring 40 by a fastening means, such as a pair of screws 60, as best seen in FIG. 5.

First ring retainer block 54 has an arcuate inner surface 62 adapted to be in close spaced or sliding relationship with outside diameter 22 of container 14. First ring retainer block 54 also has an arcuate outer surface 64 and sides 66 and 67 which extend between inner surface 62 and outer surface 64. Second ring retainer block 56 is substantially identical to first ring retainer block 54. It will thus be seen that as lower ring 38 and first ring retainer block 54 are simultaneously rotatable with respect to container 14. It will also be seen that upper ring 40 and second ring retainer block 56 are similarly simultaneously rotatable with respect to container 14.

Figure 4:
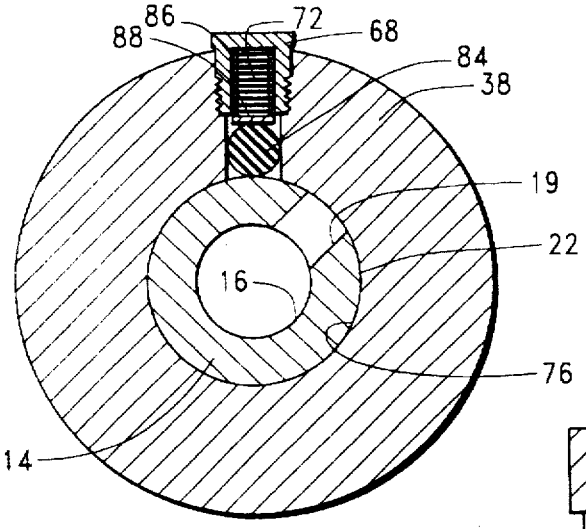
FIG. 4 is a transverse cross section taken along lines 4—4 in FIG. 1.

Referring now to FIGS. 1, 2 and 4, lower ring 38 has a first cap 68 attached thereto at threaded connection 70. Lower ring 38 and first cap 68 define a first ball cavity 72 therein. As seen in FIG. 1, the radially inner side of cavity 72 is substantially closed by outside diameter 22 of container 14 when ball drop head 10 is in the closed position illustrated. A sealing means, such as a pair of O-rings 74 provide sealing engagement between inside diameter 76 of lower ring 38 and outside diameter 22 of container 14 on opposite sides of cavity 72.

Upper ring 40 has a second cap 78 attached thereto at threaded connection 80. A second ball cavity 82 is defined in upper ring 40 and second cap 78. In the closed position shown in FIG. 1, cavity 82 is closed on its radially inner side by outside diameter 22 of container 14. A sealing means, such as a pair of spaced O-rings 83, provide sealing engagement between outside diameter 22 of container 14 and inside diameter 85 of upper ring 40 on opposite sides of cavity 82.

Disposed in first ball cavity 72 are a first or lower ball 84 and a biasing means, such as coiled spring 86. Spring 86 may be fixedly attached to first cap 68 by any means known in the art, such as by welding. A disc 88 is disposed between spring 86 and first ball 84 and may be attached to the spring. In the first, closed position shown in FIG. 1, spring 86 is compressed or pre-loaded so that it radially inwardly biases disc 88, and thus first ball 84, toward container 14.

Disposed in second ball cavity 82 are a second or upper ball 90 and another biasing means, such as a coiled spring 92. Spring 92 may be fixedly attached to second cap 78 by any means known in the art, such as by welding. A disc 94 is disposed between spring 92 and second ball 90 and may be attached to spring 92. In the first, closed position shown in FIG. 1, spring 92 is compressed or pre-loaded so that it radially inwardly biases disc 94 and second ball 90 toward container 14.

In the illustrated embodiment, first ball 84 and second ball 90 have different diameters, but the invention is not intended to be limited to such a configuration. The ball sizes are determined by the use of the balls when they are dropped down the tubing or casing string into the well. While the illustrated embodiment utilizes two rings 38 and 40 and two balls 84 and 90, respectively, the invention is not intended to be limited to an apparatus having two and only two rotating rings. Depending upon the number of balls it is necessary to drop into the well, one or more rotating rings and a corresponding number of balls may be utilized.

Referring again to FIG. 3, a first bellows 96 is positioned between first container retainer block 42 and first ring retainer block 54. First bellows 96 is of a kind known in the art, such as a Firestone 4001 bellows, which has a centrally positioned inflatable element 98 with a head 100 and a body 102 on opposite ends thereof. Body 102 closes one end of element 98 and is attached to side 66 of first ring retainer block 54 by a fastening means, such as a stud 104.

Figure 7:
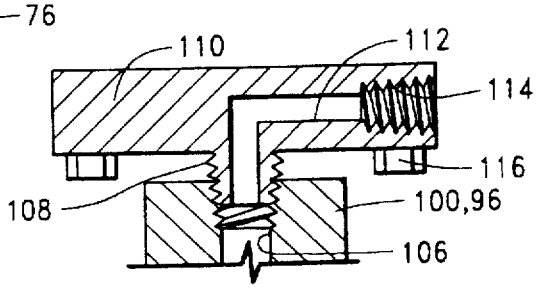
FIG. 7 shows a cross-sectional detail of a manifold block connected to a bellows.

Referring also to FIG. 7, head 100 defines an inlet 106 therein. Inlet 106 is connected to a threaded connector portion 108 of a first manifold block 110. Manifold block 110 defines a substantially L-shaped passageway 112 therein which is in communication with inlet 106 of head 100 of bellows 96. The outer end of passageway 112 has a threaded opening 114 which is used to connect manifold block 110 to a hydraulic or pneumatic pressure source (not shown) of a kind known in the art.

Manifold block 110 is attached to first container retainer block 42 by a fastening means, such as a plurality of screws 116.

A second bellows 118 is disposed between second container retainer block 44 and second ring retainer block 56. Second bellows 118 is substantially identical to first bellows 96 and has a centrally positioned inflatable element 120 with a head 122 and a body 124 on opposite ends thereof. Body 124 is attached to second ring retainer block 56 by a fastening means such as a stud 126. Head 122 is connected to a second manifold block 128 in a manner substantially identical to the connection of head 100 of first bellows 96 to first manifold block 110. Second manifold block 128 is also adapted for connection to the same or another hydraulic or pneumatic pressure source (not shown) as manifold block 110.

Second manifold block 128 is attached to second container retainer block 44 by a fastening means, such as a plurality of screws 130.

OPERATION OF THE INVENTION

Ball drop head 10 is connected to tubing or casing string 12 in the first, closed position shown in FIG. 1. All of the other appropriate piping and hose connections are made, after which ball drop head 10 is ready for use.

When it is desired to drop first ball 84 into the well, element 98 of first bellows 96 is inflated by applying hydraulic or pneumatic pressure to first manifold block 110. This inflation of element 98 moves head 100 and body 102 of first bellows 96 further apart. It will be seen by those skilled in the art that this results in a clockwise rotation of first ring retainer block 54 as seen in FIG. 3 which also rotates lower ring 38 clockwise. First container retainer block 42 does not rotate because it is fixedly attached to container 14. The rotation continues until side 67 of first ring retainer block 54 contacts side 51 of second container retainer block 44. Thus, a stop means is provided for limiting movement of first ring retainer block 54 and lower ring 38. When movement of lower ring 38 is thus stopped, first cavity 72 is in a second, open position in substantial alignment with first ball release opening 19 in container 14. At this point, radially inward movement of first ball 84 is no longer limited, and spring 86 biases the first ball radially inwardly, at which point it is free to drop through opening 19 and central opening 16 into the well. Angled surface 20 will be seen to facilitate the downward movement of first ball 84.

When it is desired to drop second ball 90, upper ring 40 is rotated in a similar manner. That is, element 120 of second bellows 118 is inflated to force head 122 and body 124 apart and rotate second ring retainer block 56 in a clockwise direction as seen in FIG. 3. This, of course, results in clockwise rotation of upper ring 40. This rotation is stopped by engagement of side 67 of second ring retainer block 56 with side 51 of first container retainer block 42. Thus, a stop means is provided for limiting movement of second ring retainer block 56 and upper ring 40. When upper ring 40 is thus rotated, second cavity 82 is in a second, open position in substantial alignment with second ball release opening 17 in container 14 such that radially inward movement of second ball 90 is no longer restricted. Spring 92 radially inwardly biases ball 90 so that it enters opening 17, after which it is free to fall through opening 17 and central opening 16 into the well. Angled surface 18 facilitates downward movement of second ball 90.

While operation of ball drop head 10 has been described with dropping of lower ball 84 before upper ball 90, the positioning of the balls is not important in the apparatus. That is, an upper ball may be dropped before a lower ball and vice versa.

Although a hydraulic or pneumatic remote control actuation of ball valve head 10 has been described as a preferred embodiment, other means of rotation of lower ring 38 and upper ring 40 may be utilized. For example, but not by way of limitation, lower ring 38 and upper ring 40 may simply be rotated manually when desired or rotated by a screw driven by an electric motor.

The compact arrangement of ball drop head 10 with rotating rings 38 and 40 results in an easier apparatus to use than prior ball injection devices which utilize linear actuators. Such linear actuators protrude from the side of the container far enough to sometimes be a problem on the rig floor. This problem is eliminated by the rotating ring design of ball drop head 10.

It will be seen, therefore, that the ball drop head with rotating rings of the present invention is well adapted to carry out the ends and advantages mentioned, as well as those inherent therein. While a presently preferred embodiment of the apparatus has been described for the purposes of this disclosure, numerous changes in the arrangement and construction of parts may be made by those skilled in the art. All such changes are encompassed within the scope and spirit of the appended claims.

What is claimed is:

1. A ball dropping apparatus for use on a well, said apparatus comprising:

container means for connecting to a tool string, said container means defining a central opening therethrough and a ball release opening in communication with said central opening;

a ball carrier defining a ball cavity therein, said ball carrier being disposed on said container means and rotatable between a first position wherein said ball cavity is angularly displaced from said ball release opening and a second position wherein said ball cavity is substantially aligned with said ball release opening;

a ball disposed in said ball cavity; and a device for biasing said ball toward said ball release opening when said ball carrier is in said second position.

2. The apparatus of claim 1 further comprising actuating means for moving said ball carrier from said first to said second position.

3. The apparatus of claim 2 wherein said actuating means is characterized by an inflatable bellows.

4. The apparatus of claim 3 further comprising:

a container retainer block attached to said container means; and a ball carrier retainer block attached to said ball carrier;

wherein, said bellows is disposed between said container retainer block and said ball carrier retainer block such that, as said bellows is inflated, said ball carrier retainer block and said ball carrier are rotated with respect to said container retainer block and said container.

5. The apparatus of claim 4 further comprising stop means for limiting movement of said ball carrier retainer block.

6. The apparatus of claim 3 further comprising a manifold block disposed adjacent to one of said container and ball carrier retainer blocks, said manifold block being adapted for connection to a pressure source.

7. The apparatus of claim 1 further comprising sealing means for sealing between said ball carrier and said container means.

8. The apparatus of claim 1 wherein said ball release opening is formed at least in part by a downwardly angled surface of said container means.

9. The apparatus of claim 1 wherein said device is characterized by a spring disposed in said ball cavity adjacent to said ball.

10. The apparatus of claim 1 further comprising retaining means for retaining said device in said ball carrier.

11. A ball drop head for use in dropping balls into a well, said ball drop head comprising:

a container defining a central opening therethrough, a first ball release opening and a second ball release opening, said ball release openings being in communication with said central opening;

a first container retainer block attached to said container;

a second container retainer block attached to said container;

a first ring rotatably disposed on said container, said first ring defining a first ball cavity therein and being movable between a closed position wherein said first ball cavity is unaligned with said first ball release opening and a second position wherein said first ball cavity is aligned with said first ball release opening;

a second ring rotatably disposed on said container, said second ring defining a second ball cavity therein and being movable between a closed position wherein said second ball cavity is unaligned with said second ball release opening and a second position wherein said second ball cavity is aligned with said second ball release opening;

a first ball disposed in said first ball cavity;

a second ball disposed in said second ball cavity;

a first ring retainer block attached to said first ring; and a second ring retainer block attached to said second ring.

12. The ball drop head of claim 11 wherein:

said first and second rings are disposed on longitudinally opposite sides of said first and second container retainer blocks.

13. The ball drop head of claim 11 wherein:

said first and second ring retainer blocks are disposed between said first and second rings.

14. The ball drop head of claim 11 wherein:

movement of said first ring is limited by contact of said first ring retainer block with one of said first and second container retainer blocks; and movement of said second ring is limited by contact of said second ring retainer block with the other of said first and second container retainer blocks.

15. The ball drop head of claim 11 further comprising:

a first biasing means for biasing said first ball toward said container such that said first ball is moved into said first ball release opening when said first ring is in said second position thereof; and a second biasing means for biasing said second ball toward said container such that said second ball is moved into said second ball release opening when said second ring is in said second position thereof.

16. The ball drop head of claim 15 further comprising:

a first cap attached to said first ring and closing an end of said first ball cavity; and a second cap attached to said second ring and closing an end of said second ball cavity.

17. The ball drop head of claim 16 wherein:

said first biasing means comprises a first spring disposed in said first ball cavity between said first ball and said first cap; and said second biasing means comprises a second spring disposed in said second ball cavity between said second ball and said second cap.

18. The ball drop head of claim 11 further comprising retaining means for retaining said first biasing means in said first ball cavity and said second biasing means in said second ball cavity.

19. The ball drop head of claim 11 further comprising actuating means for actuating said first and second rings between said first and second positions thereof.

20. The ball drop head of claim 19 wherein said actuating means comprises:

a first inflatable bellows disposed between said first container retainer block and said first ring retainer block such that said first ring is moved from said first position to said second position thereof when said first bellows is inflated; and a second inflatable bellows disposed between said second container retainer block and said second ring retainer block such that said second ring is moved from said first position to said second position thereof when said second bellows is inflated.

21. The ball drop head of claim 20 further comprising:

a first manifold block disposed adjacent to an inlet of said first inflatable bellows and in communication therewith, said first manifold block being adapted for connection to a pressure source; and a second manifold block disposed adjacent to an inlet of said second inflatable bellows and in communication therewith, said second manifold block being adapted for connection to said pressure source.

22. The ball drop head of claim 21 wherein:

said first manifold block is attached to said first container retainer block;

said first inflatable bellows is attached to said first ring retainer;

said second manifold block is attached to said second container retainer block; and said second inflatable bellows is attached to said second ring retainer block.

23. The apparatus of claim 11 wherein said first ring is disposed below said second ring.

24. The ball drop head of claim 11 wherein said first and second ball release openings extend at least partially downwardly from said first and second ball cavities, respectively.

25. A method of dropping a ball into a well comprising the steps of:

(a) positioning a ball drop apparatus above said well, said apparatus comprising:

a container defining a central opening therethrough and a transverse opening in communication with said central opening;

a ring rotatably disposed on said container and defining a cavity therein, said cavity being displaced from said transverse opening when said ring is in a closed position and aligned with said transverse opening when said ring is in an open position; and a ball disposed in said cavity;

(b) rotating said ring from said closed position to said second position thereof; and (c) biasing said ball from said cavity through said transverse opening and into said central opening.

26. The method of claim 25 wherein step (a) comprises:

attaching said ball drop apparatus to a top drive unit; and lowering said ball drop apparatus with said top drive unit toward the well.

27. The method of claim 25 wherein:

said apparatus further comprises a bellows adapted for connection to said ring and said container; and step (b) comprises inflating said bellows.

28. The method of claim 25 wherein step (c) comprises positioning a pre-loaded spring in said cavity adjacent to said ball.

29. The method of claim 28 further comprising preventing said spring from entering said central opening after said step of biasing said ball.

30. The method of claim 25 wherein:

said ring is one of a plurality of rings on said container; and steps (b) and (c) may be repeated for each ring to release a corresponding ball.

31. The method of claim 30 wherein steps (b) and (c) are repeated sequentially starting with a lowermost one of said rings.

32. A ball dropping apparatus for use on a well, said apparatus comprising:

container means for connecting to a tool string, said container means defining a central opening therethrough and a ball release opening in communication with said central opening;

a ball carrier defining a ball cavity therein, said ball carrier being disposed on said container means and rotatable between a first position wherein said ball cavity is angularly displaced from said ball release opening and a second position wherein said ball cavity is substantially aligned with said ball release opening;

an actuating means characterized by an inflatable bellows for moving said ball carrier from said first to said second position; and a ball disposed in said ball cavity.

33. The apparatus of claim 32 further comprising:

a container retainer block attached to said container means; and a ball carrier retainer block attached to said ball carrier;

wherein, said bellows is disposed between said container retainer block and said ball carrier retainer block such that, as said bellows is inflated, said ball carrier retainer block and said ball carrier are rotated with respect to said container retainer block and said container.

34. The apparatus of claim 33 further comprising stop means for limiting movement of said ball carrier retainer block.

35. The apparatus of claim 32 further comprising a manifold block disposed adjacent to one of said container and ball carrier retainer blocks, said manifold block being adapted for connection to a pressure source.

36. The apparatus of claim 32 further comprising sealing means for sealing between said ball carrier and said container means.

37. The apparatus of claim 32 wherein said ball release opening is formed at least in part by a downwardly angled surface of said container means.

38. The apparatus of claim 32 further comprising biasing means for biasing said ball toward said ball release opening when said ball carrier is in said second position.

39. The apparatus of claim 38 wherein said biasing means is characterized by a spring disposed in said ball cavity adjacent to said ball.

40. The apparatus of claim 38 further comprising retaining means for retaining said biasing means in said ball carrier.

* * * * *

UNITED STATES PATENT AND TRADEMARK OFFICE

CERTIFICATE OF CORRECTION

PATENT NO. : 5,758,726

DATED : June 2, 1998

INVENTOR(S) : Steven G. Streich and David F. Laurel

It is certified that error appears in the above-indentified patent and that said Letters Patent is hereby corrected as shown below:

On the title page under the Assignee, after "Halliburton Energy Services," please insert --Inc.,--

Signed and Sealed this

Nineteenth Day of January, 1999

*Attest:*

*Attesting Officer*

*Acting Commissioner of Patents and Trademarks*